US010183484B2

(12) United States Patent
Veenstra et al.

(10) Patent No.: US 10,183,484 B2
(45) Date of Patent: Jan. 22, 2019

(54) METHOD FOR DETECTING AN OPERATING STATE OF AN INKJET PRINT HEAD NOZZLE

(71) Applicant: OCE-TECHNOLOGIES B.V., Venlo (NL)

(72) Inventors: Hylke Veenstra, Venlo (NL); Marko Mihailovic, Venlo (NL); Cornelis W. M. Venner, Venlo (NL); Amol A. Khalate, Venlo (NL); Tjerk E. C. Hummel, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/493,960

(22) Filed: Apr. 21, 2017

(65) Prior Publication Data

US 2017/0225455 A1 Aug. 10, 2017

Related U.S. Application Data

(63) Continuation of application No. PCT/EP2015/075059, filed on Oct. 29, 2015.

(30) Foreign Application Priority Data

Oct. 30, 2014 (EP) ..... 14191021

(51) Int. Cl.
*B41J 2/045* (2006.01)
*B41J 2/21* (2006.01)
(Continued)

(52) U.S. Cl.
CPC ..... *B41J 2/0451* (2013.01); *B41J 2/04581* (2013.01); *B41J 2/16579* (2013.01);
(Continued)

(58) Field of Classification Search
CPC ..... B41J 2/2142
See application file for complete search history.

(56) References Cited

U.S. PATENT DOCUMENTS

2005/0225581 A1* 10/2005 Boesten ..... B41J 2/0451 347/10
2009/0079799 A1 3/2009 Sato
(Continued)

FOREIGN PATENT DOCUMENTS

KR 10-2012-0125908 A 11/2012

*Primary Examiner* — Shelby L Fidler
(74) *Attorney, Agent, or Firm* — Birch, Stewart, Kolasch & Birch, LLP

(57) ABSTRACT

For assessing the functioning of an ejection unit of an inkjet print head, a comparison of a residual pressure wave with a residual pressure wave reference is employed. To enable assessment during printing, multiple residual pressure wave references are provided, each relating to a condition relevant to the residual pressure wave. Such a condition may relate to an actuation status of an adjacent ejection unit which may cause crosstalk, for example. When performing the assessment, the condition during assessment is taken into account, for example for selecting a suitable residual pressure wave reference, such that an appropriate and correct assessment can be performed independent from the conditions during assessment.

10 Claims, 5 Drawing Sheets

(51) Int. Cl.

| | |
|---|---|
| ***B41J 2/165*** | (2006.01) |
| ***B41J 2/14*** | (2006.01) |
| ***B41J 2/325*** | (2006.01) |
| ***B41J 2/355*** | (2006.01) |

(52) U.S. Cl.
CPC ..... *B41J 2/2142* (2013.01); *B41J 2/325* (2013.01); *B41J 2/355* (2013.01); *B41J 2002/14354* (2013.01)

(56) References Cited

U.S. PATENT DOCUMENTS

| | | | | |
|---|---|---|---|---|
| 2012/0147081 | A1 | 6/2012 | Sato | |
| 2012/0206532 | A1 | 8/2012 | Kim et al. | |
| 2012/0293576 | A1 | 11/2012 | Kim et al. | |
| 2013/0278657 | A1 | 10/2013 | Martin et al. | |
| 2013/0293610 | A1* | 11/2013 | Suzuki | B41J 2/04541 347/10 |
| 2014/0098163 | A1* | 4/2014 | Reinten | B41J 2/14233 347/47 |
| 2014/0247301 | A1* | 9/2014 | Suzuki | B41J 2/04506 347/19 |
| 2016/0082720 | A1* | 3/2016 | Ready | B41J 2/04506 347/14 |
| 2016/0207340 | A1* | 7/2016 | Takano | B41J 29/393 |

* cited by examiner

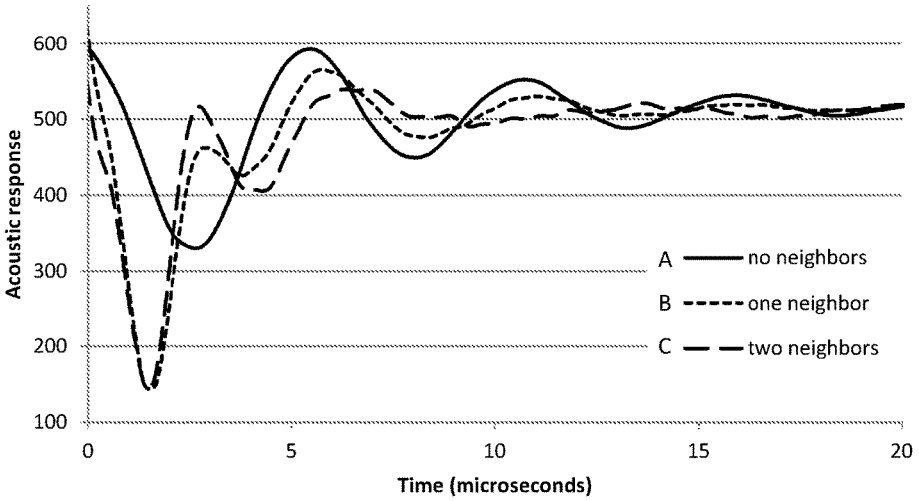
Fig. 2
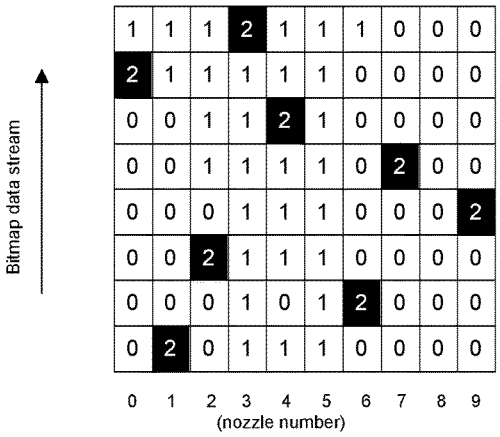
Fig. 3A
| | | | |
|---|---|---|---|
| A | 0 2 0 | | average acoustic signal without jetting neighbors |
| B | 1 2 0 or 0 2 1 | | average acoustic signal with one jetting neighbor |
| C | 1 2 1 | | average acoustic signal with 2 jetting neighbors |
Fig. 3B Bitmap data stream

| | | | | | | | | | |
|---|---|---|---|---|---|---|---|---|---|
| 1 | 1 | 1 | 4 | 1 | 1 | 1 | 0 | 0 | 0 |
| 3 | 1 | 1 | 1 | 1 | 1 | 0 | 0 | 0 | 0 |
| 0 | 0 | 1 | 1 | 4 | 1 | 0 | 0 | 0 | 0 |
| 0 | 0 | 1 | 1 | 1 | 1 | 0 | 2 | 0 | 0 |
| 0 | 0 | 0 | 1 | 1 | 1 | 0 | 0 | 0 | 2 |
| 0 | 0 | 3 | 1 | 1 | 1 | 0 | 0 | 0 | 0 |
| 0 | 0 | 0 | 1 | 0 | 1 | 3 | 0 | 0 | 0 |
| 0 | 2 | 0 | 1 | 1 | 1 | 0 | 0 | 0 | 0 |
| 0 | 1 | 2 | 3 | 4 | 5 | 6 | 7 | 8 | 9 |

(nozzle number)

Fig. 4A

| | | | |
|---|---|---|---|
| A | 0 2 0 | | average acoustic signal without jetting neighbors |
| B | 1 3 0 or 0 3 1 | | average acoustic signal with one jetting neighbor |
| C | 1 4 1 | | average acoustic signal with 2 jetting neighbors |

Fig. 4B

| | | | | | | | | | |
|---|---|---|---|---|---|---|---|---|---|
| 1 | 1 | 1 | 0 | 1 | 1 | 1 | 0 | 0 | 0 |
| 0 | 1 | 1 | 1 | 1 | 1 | 0 | 0 | 0 | 0 |
| 0 | 0 | 1 | 1 | 0 | 1 | 0 | 0 | 0 | 0 |
| 0 | 0 | 1 | 1 | 1 | 1 | 0 | 0 | 0 | 0 |
| 0 | 0 | 0 | 1 | 1 | 1 | 0 | 0 | 0 | 0 |
| 0 | 0 | 0 | 1 | 1 | 1 | 0 | 0 | 0 | 0 |
| 0 | 0 | 0 | 1 | 0 | 1 | 0 | 0 | 0 | 0 |
| 0 | 0 | 0 | 1 | 1 | 1 | 0 | 0 | 0 | 0 |

| | | | | | | | | | |
|---|---|---|---|---|---|---|---|---|---|
| 1 | 1 | 1 | 0 | 1 | 1 | 1 | 0 | 0 | 0 |
| 0 | 1 | 1 | 1 | 1 | 1 | 0 | 0 | 0 | 0 |
| 0 | 0 | 1 | 1 | 0 | 1 | 0 | 0 | 0 | 0 |
| 0 | 0 | 1 | 1 | 1 | 1 | 0 | 0 | 0 | 0 |
| 0 | 0 | 0 | 1 | 1 | 1 | 0 | 0 | 0 | 0 |
| 0 | 0 | 0 | 1 | 1 | 1 | 0 | 0 | 0 | 0 |
| 0 | 0 | 0 | 1 | 0 | 1 | 0 | 0 | 0 | 0 |
| 0 | 0 | 0 | 1 | 1 | 1 | 0 | 0 | 0 | 0 |

| | | | | | | | | | |
|---|---|---|---|---|---|---|---|---|---|
| 1 | 1 | 1 | 4 | 1 | 1 | 1 | 0 | 0 | 0 |
| 3 | 1 | 1 | 1 | 1 | 1 | 0 | 0 | 0 | 0 |
| 0 | 0 | 1 | 1 | 4 | 1 | 0 | 0 | 0 | 0 |
| 0 | 0 | 1 | 1 | 1 | 1 | 0 | 2 | 0 | 0 |
| 0 | 0 | 0 | 1 | 1 | 1 | 0 | 0 | 0 | 2 |
| 0 | 0 | 3 | 1 | 1 | 1 | 0 | 0 | 0 | 0 |
| 0 | 0 | 0 | 1 | 0 | 1 | 3 | 0 | 0 | 0 |
| 0 | 2 | 0 | 1 | 1 | 1 | 0 | 0 | 0 | 0 |

Fig. 5

METHOD FOR DETECTING AN OPERATING STATE OF AN INKJET PRINT HEAD NOZZLE

CROSS REFERENCE TO RELATED APPLICATIONS

This application is a Continuation of PCT International Application No. PCT/EP2015/075059 filed on Oct. 29, 2015, which claims priority under 35 U.S.C. § 119(a) to Patent Application No. 14191021.6 filed in Europe on Oct. 30, 2014, all of which are hereby expressly incorporated by reference into the present application.

FIELD OF THE INVENTION

The present invention generally pertains to a method for controlling an inkjet print head in order to detect an operating state of an ejection unit having a nozzle.

BACKGROUND ART

A piezo actuated inkjet print head is well known in the art. Such an inkjet print head is commonly provided with a number of ejection units. Each of such ejection units comprises a pressure chamber and a fluidly connected nozzle. The pressure chamber may be filled with a liquid such as an ink and a droplet of the liquid may be expelled through the nozzle by application of a suitable pressure wave in the liquid in the pressure chamber by actuating a piezo actuator that is operatively coupled to the pressure chamber for generating such a pressure wave.

It is also known in the art that the ejection units are sensitive and may become malfunctioning due to a gas bubble, commonly an air bubble, entrapped in the nozzle or pressure chamber. Similarly, dirt or debris may enter the nozzle and cause malfunctioning. Other causes for malfunctioning include liquid residues around the nozzle, electrical failures, drying of the liquid in the nozzle resulting in increased viscosity and deposits of dissolved compounds of the liquid and many more.

When an ejection unit malfunctions, it means that a droplet is not formed correctly. Still after generating a pressure wave, either for droplet ejection or not, a residual pressure wave remains in the liquid and then slowly damps. Characteristic properties of such a residual pressure wave are known to provide detailed information on the cause of the malfunctioning. Therefore and as known, sensing and analyzing such a residual pressure wave may provide detailed information on an operating state of an ejection unit.

In particular, analysis of the residual pressure wave may include comparing the sensed residual pressure wave with a residual pressure wave reference. For example, a residual pressure wave detected from a well functioning ejection unit may be used to determine whether a sensed residual pressure wave corresponds to a well functioning ejection unit. Then, if from an analysis a significant difference between the sensed residual pressure wave and the residual pressure wave reference is derived, it may be concluded that the ejection unit is in a malfunctioning state.

A disadvantage of the above-described known analysis method is that the conditions during which the residual pressure wave is sensed need to be identical to the conditions under which the residual pressure wave reference has been detected. In the prior art, it is therefore known to sense a residual pressure wave when all other ejection units are not actuated, for example, as those other ejection units may cause cross-talk thereby disturbing the sensed residual pressure wave. For example and as a consequence, the detection of an operating state is commonly only performed when the print head is in a non-printing state. However, it is desirable to be able to detect an operating state of an ejection unit also when the print head is in a printing state. More in general, it is desirable to have more flexibility in conditions that are suitable for sensing and analyzing a residual pressure wave.

SUMMARY OF THE INVENTION

In an aspect of the present invention, a method for detecting an operating state of an ejection unit of an inkjet print head is provided. The inkjet print head comprises a first ejection unit and a second ejection unit and each ejection unit comprises a pressure chamber for holding an amount of liquid; an actuator operatively coupled to the pressure chamber, configured for generating a pressure wave in the amount of liquid; a sensor operatively coupled to the pressure chamber for sensing a residual pressure wave in the amount of liquid; and an orifice operatively coupled to the pressure chamber for ejecting a droplet of liquid upon generation of an ejecting pressure wave. The method comprises the steps of a) generating a pressure wave in the amount of liquid in the pressure chamber of the first ejection unit;
b) sensing a residual pressure wave in the amount of liquid in the pressure chamber of the first ejection unit;
c) providing a set of at least two residual pressure wave references, each residual pressure wave reference relating to a respective residual pressure wave sensing condition, the residual pressure wave sensing condition corresponding to an operating condition of the second ejection unit;
d) comparing the residual pressure wave as sensed in step b) with at least one residual pressure wave reference comprised in the set of residual pressure wave references for determining the operating state of the first ejection unit.

In the method according to the present invention, there is a set of at least two residual pressure wave references provided. Each respective residual pressure wave reference corresponds to certain sensing conditions. In particular, one of the residual pressure wave references in the set may correspond to the operation condition wherein the second ejection unit is not actuated and another one may correspond to the condition wherein the second ejection unit is actuated, potentially causing cross-talk.

Having such a set of multiple residual pressure wave references available allows performing the residual pressure wave sensing under a corresponding set of sensing conditions. In an embodiment, such sensing conditions are known when performing the actual residual pressure wave sensing. Therefore, in such embodiment, the method according to the present invention provides a step of determining whether a pressure wave—residual or not—is present in another ejection unit. Based on this determination, it is enabled to select a residual pressure wave reference from the set corresponding to the actual sensing conditions. Then, having selected a suitable residual pressure wave reference, a suitable and accurate analysis is enabled.

In another embodiment, the residual pressure wave is compared with each residual pressure wave reference. In such embodiment, the actual sensing conditions do not have to be known a priori. If the residual pressure wave corresponds to any one of the residual pressure wave references, it may be concluded that the ejection unit is in an operative state. Moreover, it may be determined under which sensing conditions the residual pressure wave sensing has been performed.

The above two embodiments may even be combined into a further embodiment. In such embodiment, the conditions during sensing are known and the residual pressure wave is compared to each residual pressure wave references. If the residual pressure wave does not correspond to the residual pressure wave reference of the known sensing conditions, but the residual pressure wave does correspond to another residual pressure wave reference, it may be suspected or concluded that the second ejection unit is not operating correctly.

For obtaining the set of residual pressure wave references, it is noted that a single ejection unit may be probed and its residual pressure wave may be used as a residual pressure wave reference, taking into account the relevant sensing conditions. This requires strict knowledge on the actual status of the ejection unit to prevent that a residual pressure wave reference is based on a mal-functioning ejection unit. Therefore, in such embodiment, the residual pressure wave references are usually predetermined under controlled conditions. However, the operating conditions may change over time, e.g. due to aging of piezo-electric material. In another embodiment, a relatively large number of ejection units may be probed for their residual pressure waves (all having a same relevant condition in accordance with the present invention) and an average of those residual pressure waves may be used as a residual pressure wave reference. In a particular embodiment, a statistical analysis may be used to remove inappropriate residual pressure waves such as those resulting from mal-functioning ejection units, before averaging. Such a method may be performed regularly in a calibration procedure, not requiring specific controlled conditions, while ensuring that the residual pressure wave reference corresponds to the actual conditions.

It is noted that, as used herein, comparing a residual pressure wave and a residual pressure wave reference may be a simple determination of a difference between the two, but it may additionally or alternatively include complex computations and/or a comparison of certain properties, such as frequency, amplitude, phase shifts and the like. The person skilled in the art will readily understand that, in the latter case, the residual pressure wave reference may be a set of properties instead of a fluctuating signal corresponding to an actual residual pressure wave. So, in general, the present invention is not to be limited to any kind of analysis of the sensed residual pressure wave relative to a residual pressure wave reference.

In a practical embodiment of the method according to the present invention, the pressure chamber of the second ejection unit is adjacent to the pressure chamber of the first ejection unit. It has appeared from technical experiments that a cross-talk contribution from pressure generation in pressure chambers that are not adjacent to the ejection unit subjected to an operating state detection method may have such a limited cross-talk contribution, that those may be ignored. Thus, only a cross-talk contribution from an adjacent pressure chamber needs to be taken into account.

In an embodiment, each ejection unit comprises a piezo-electric element, the piezo-electric element having a piezo-electric layer, a first electrode arranged on a first side of the piezo-electric layer and a second electrode arranged on a second side opposite to the first side. The piezo-electric element is configured to function as the actuator when a driving voltage is applied over the first and second electrodes and to function as the sensor when no driving voltage is applied. Upon application of a driving voltage over the electrodes the electric field induces a mechanical deformation of the piezo-electric element, which deformation may be employed to generate the pressure wave in the liquid in the pressure chamber. On the other hand, when no driving voltage is applied, a residual pressure wave in the liquid may mechanically deform the piezo-electric element. As a consequence, a voltage is generated over the electrodes. Sensing this voltage provides a sensing signal corresponding to the residual pressure wave. Thus, such a piezo-electric element may be advantageously employed as both the actuator and the sensor.

The method according to the present invention allows performing the operating state detection also when the print head is printing. For example, in an embodiment, the method may be performed while an image is printed by image-wise ejection of droplets from the inkjet print head, wherein step c) comprises determining the presence of a pressure wave in the second ejection unit based on print data, the print data indicating when an ejection unit is to eject a droplet. Commonly, print data is supplied to a print head indicating which ejection unit needs to expel a droplet and when. Thus, while print head and recording medium, e.g. paper, are controlled to move relative to each other, droplets are expelled with such a timing that the droplets land on the recording medium at a desired position. Thus, an image may be formed on the recording medium.

Detecting an operating state of an ejection unit may be performed based on a residual pressure wave that remains directly after a droplet is expelled after generating an ejecting pressure wave. Similarly, the detection may be performed based on a residual pressure wave that is deliberately generated by generating a non-ejecting pressure wave, i.e. a pressure wave that does not result in a droplet being expelled. Of course, in accordance with the present invention, separate residual pressure wave references may be provided for the potentially different residual pressure waves. Still, and regardless of the method of generating the residual pressure wave, the print data may be used to determine whether a pressure wave is generated in other ejection units, such as in an adjacent ejection unit. Thus, it is enabled to easily and quickly determine which residual pressure wave reference could be used for the subsequent analysis of the sensed residual pressure wave.

In an embodiment, the print data may be provided with state detection data. Thus, the print data will not only indicate when an ejection unit should expel a droplet based on image data, but the print data will also indicate when the operating state of the ejection unit is to be detected based on the state detection data. In this embodiment, for example based on the image data, it may be determined prior to starting a print job when an ejection unit may be probed for its operating state without affecting the resulting image. In a particular embodiment, the state detection data may indicate whether the detection is to be based on an ejecting pressure wave or on a non-ejecting pressure wave (as above elucidated). Additionally or alternatively, the state detection data may include data about the generation of a pressure wave in other ejection units at the time of the state detection of the ejection unit (for example the print data relating to those other ejection units corresponding to the timing of the state detection of the first ejection unit), such as an adjacent ejection unit. Even further, to reduce computations during printing, the state detection data may include a reference parameter indicating which residual pressure wave reference to use or the state detection data may even include the residual pressure wave reference itself. Thus, certain steps of the method according to the present invention may, in such an embodiment, be performed before the print job is actually started.

It is noted that, as used herein, a residual pressure wave reference relates to an operative state of the ejection unit. From the prior art, it is known to derive a cause for a malfunctioning nozzle from the residual pressure wave by comparison with a number of residual pressure wave references corresponding to certain causes such as the presence of an air bubble, dirt, or an electrical failure, for example. These prior art residual pressure wave references do not consider the conditions applicable to the time at which the residual pressure wave is sensed, as suitable conditions were ensured before sensing, usually ensuring that no pressure wave is present in nearby other ejection units.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein:

FIG. 2 is a graph showing a number of residual pressure waves originating from correctly functioning ejection units;

FIG. 3A is a schematic representation illustrating of a first embodiment of print data usable in the present invention;

FIG. 3B is a schematic representation of a set of residual pressure wave references usable with the first embodiment of FIG. 3A;

FIG. 4A is a schematic representation illustrating of a second embodiment of print data usable in the present invention;

FIG. 4B is a schematic representation of a set of residual pressure wave references usable with the second embodiment of FIG. 4A;

FIG. 5 is a schematic representation of a process for obtaining the print data according to FIG. 4A;

DETAILED DESCRIPTION OF THE DRAWINGS

Figure 1A:
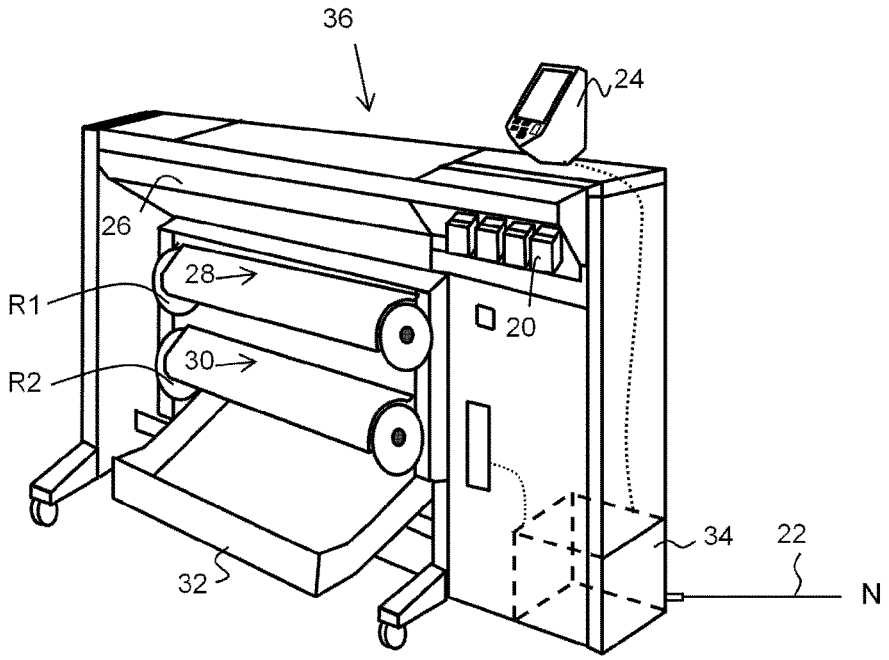
FIG. 1A is a perspective view of an exemplary image forming apparatus suitable for use with the present invention.

The present invention will now be described with reference to the accompanying drawings, wherein the same reference numerals have been used to identify the same or similar elements throughout the several views.

Figure 1B:
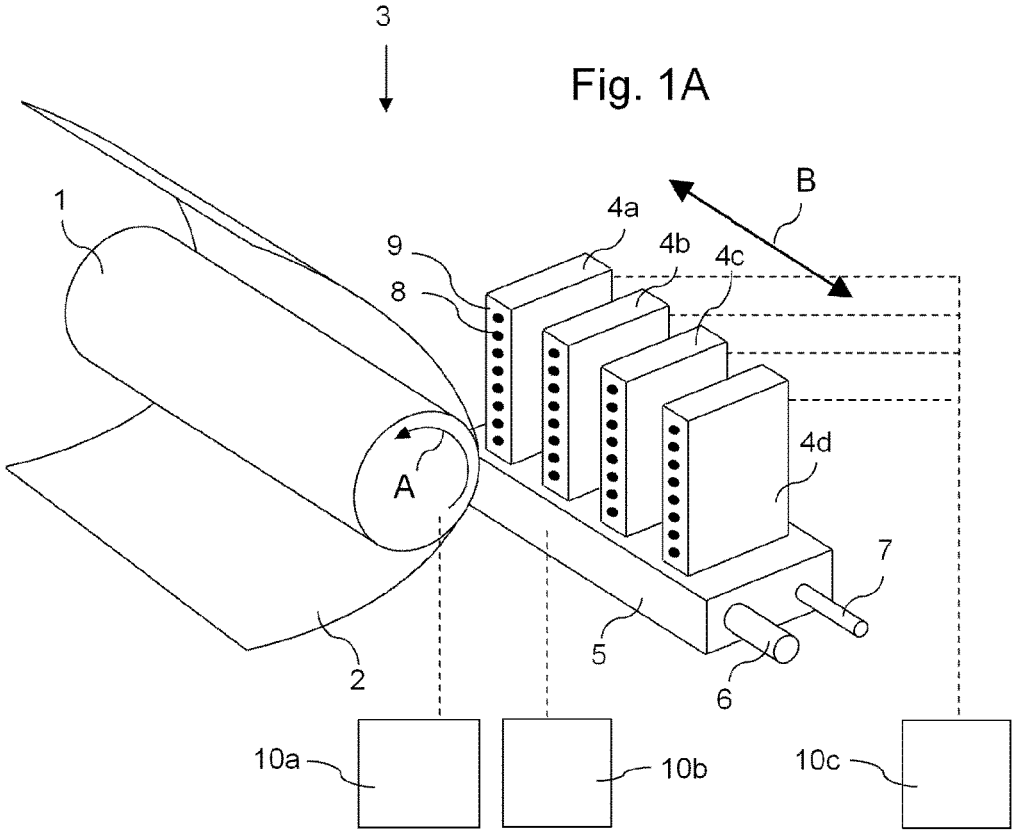
FIG. 1B is a schematic representation illustrating a scanning inkjet process.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

For use with the present invention, the print heads 4*a*-4*d* has a number of ejection units, each ejection unit corresponding to one of the orifices 8. An ejection unit comprises a pressure chamber in which a pressure wave may be generated, e.g. by suitably driving a piezo-electric element associated with the ejection unit. The pressure wave may be such that a droplet of marking material is expelled through the corresponding orifice or the pressure wave may be such that no droplet is expelled. The latter is commonly known for vibrating a meniscus of the marking material, for example.

Likewise, a non-expelling pressure wave is known for use with an acoustic sensing method for detecting an operating state of the ejection unit. For example, if an air bubble is entrained in the pressure chamber of the ejection unit, the acoustics in the pressure chamber are different compared to the situation where no air bubble is present. As a consequence, a generated pressure wave will be different, too. Detecting and analyzing the pressure wave, which is referred to herein as the residual pressure wave, allows determining an operating state of the ejection unit. This method is known in the prior art and to the skilled person. Therefore, this method is not further elucidated herein.

FIG. 2 illustrates three residual pressure waves. The horizontal axis of the graph represents time in microseconds and the vertical axis represents amplitude of the residual pressure waves in arbitrary units.

A first residual pressure wave A ('no neighbors') relates to a condition wherein none of any adjacent ejection units is actuated; a second residual pressure wave B ('one neighbor') relates to a condition wherein one adjacent ejection unit is actuated; and a third residual pressure wave C ('two neighbors') relates to a condition wherein two adjacent ejection units (one on each side of the probed ejection unit) are actuated. Note that actuating an ejection unit, i.e. generating a pressure wave in the pressure chamber, usually affects any adjacent pressure chamber due to mechanical and/or acoustic cross-talk, thus resulting in a pressure wave in the adjacent pressure chamber. If an ejection unit is probed for determining the residual pressure wave, while an adjacent ejection unit is actuated, for example for expelling a droplet, the resulting residual pressure wave will likewise be affected. Indeed, as apparent from FIG. 2, the first, second and third residual pressure waves A, B, C have different properties. For example, at about 2 microseconds, the second and third residual pressure waves B, C (each having actuated adjacent ejection units) have an amplitude of about 150 a.u. which is significantly different than the first residual pressure wave A (no actuated adjacent ejection units) which has an amplitude of about 400 a.u.

In order to enable determining an operating state of an ejection unit, while adjacent ejection units are actuated simultaneously, the present invention provides not only a residual pressure wave reference for the condition wherein none of the adjacent ejection units is actuated. Instead, for a number of conditions affecting the residual pressure wave, a corresponding residual pressure wave may be provided. Herein, as an exemplary embodiment, there are three residual pressure wave references corresponding to the first, second and third residual pressure waves A, B, C as presented in FIG. 2. It will be apparent to those skilled in the art, that in a practical embodiment these and/or other conditions may be taken into account depending on the embodiment of the print head and/or any conditions relevant to the operation of the print head and/or any other relevant aspects.

The present invention thus enables to probe ejection units during a print job as the actuation of adjacent ejection units is not limiting the probing. FIGS. 3A and 3B illustrate a first embodiment of such a method. FIG. 3A illustrates an array representing print data. The array comprises 10 columns, each column representing print data for an ejection unit ('nozzle number': 0 . . . 9) of a print head. So, each column comprises a data stream ('bitmap data stream') for an ejection unit. The ejection unit is actuated over time corresponding to the data in the column. The data in each cell of the array indicates the intended operation of the corresponding ejection unit. In particular, a '0' represents no actuation, a '1' represents expelling a droplet and '2' represents probing and detecting a residual pressure wave. Note that in this exemplary embodiment, a residual pressure wave is only detected after generating a non-expelling pressure wave. In a practical embodiment, the detection may also be performed after generating a droplet-expelling pressure wave, in which case another residual pressure wave reference may be needed in accordance with the present invention. Further note that the cells having a '2' are emphasized by a black background. This is merely for illustrative purposes and has no other or additional meaning.

The print data illustrated in FIG. 3A thus comprises two kinds of data: image data represented by '0' and '1' and state detection data represented by '2'. The pattern of the '1'-containing cells corresponds to the image to be printed. In any cell in the array containing no '1', state detection data may be introduced in order to determine the operating state of the corresponding ejection unit. This may be performed on-the-fly, i.e. during printing or the state detection data may be added when the image data are prepared for printing. If and when a state detection is performed on an ejection unit may be determined by a simple predetermined scheme or may be made dependent on the image to be printed. For example, it may be considered to probe an ejection unit if it is not used for a certain period of time and the ejection unit is intended to start ejecting image droplets soon. In order to prevent image distortion, it may be advantageous to perform a state detection. In another embodiment, the print data may comprise meniscus vibration data for vibrating the meniscus of the marking material, which is well known in the art as above described. It may be contemplated to perform a state detection after a pressure wave is generated for meniscus vibration, for example. Other methods and timing schemes may be employed with the present invention as well as the present invention is not limited to any of such timing schemes or methods.

After probing and detection of the residual pressure wave, a residual pressure wave reference may be selected based on the print data of the adjacent ejection units. For that purpose, referring to FIG. 3B, a set of three residual pressure wave references A, B, C corresponding to the residual pressure waves A, B, C of FIG. 2 are provided. In particular, residual pressure wave reference A is a residual pressure wave reference to be used if in the diagram of FIG. 3A, a pattern 0-2-0 is present, wherein both numbers '0' correspond to the adjacent ejection units and the number '2' corresponds to the probed ejection unit. Similarly, the residual pressure wave reference B is a residual pressure wave reference to be used if in the diagram of FIG. 3A, a pattern 1-2-0 or 0-2-1 is present, wherein the number '0' and the number '1' correspond to the adjacent ejection units and the number '2' corresponds to the probed ejection unit; the residual pressure wave reference C is a residual pressure wave reference to be used if in the diagram of FIG. 3A, a pattern 1-2-1 is present, wherein both numbers '1' correspond to the adjacent ejection units and the number '2' corresponds to the probed ejection unit.

So, based on the table as shown in FIG. 3B, it is enabled to select a suitable residual pressure wave reference A, B or C based on the print data as shown in FIG. 3A.

In a particular example, the ejection unit having nozzle number '6' (FIG. 3A) has state detection data number '2' in its second row. The adjacent ejection unit having nozzle number '5' has image data number '1' and the adjacent ejection unit having nozzle number '7' has image data number '0'. Hence, the pattern 1-2-0 is relevant for determining the residual pressure wave reference A, B, C to be selected. Turning to the table of FIG. 3B, the pattern 1-2-0 corresponds to residual pressure wave reference B, which is therefore to be used for analyzing the detected residual pressure wave in ejection unit having nozzle number '6'.

FIG. 4A shows another embodiment of print data. The representation of print data in FIG. 4A corresponds to the representation in FIG. 3A; similarly, the representations of residual pressure wave references A, B, C in FIGS. 3B and 4B correspond. In the embodiment of FIGS. 4A and 4B, the state detection data is not limited to the number '2', but may be represented by a number '2', '3' or '4'. The probing and detection of the residual pressure wave may be the same, while the different numbers of the state detection data refer to different residual pressure wave references A, B, C. In particular, as apparent from FIG. 4B, if the state detection data is a number '2', residual pressure wave reference A is to be used; if the state detection data is a number '3', residual pressure wave reference B is to be used; and if the state detection data is a number '4', residual pressure wave reference C is to be used.

Using these multiple numbers for state detection data enables selecting the relevant residual pressure wave reference before starting printing. Thus, the controlling means of the print heads are relieved from selecting the residual pressure wave reference during printing and thus less computing power is required during printing, which may allow a simpler or more cost-effective controlling means.

Whether the state detection data is a number '2', '3' or '4' is dependent on the image data ('0' or '1') of the adjacent ejection units. An exemplary process of selecting such state detection data is illustrated by FIG. 5. Starting from print data having only image data ('0' or '1') and based on a predetermined method, certain print data are selected for state detection. These print data are marked by a black background of their cells. In this example, only image data '0' have been selected, but the present invention is not limited to such example as above described.

Then, for the selected image data, the image data of their adjacent cells is assessed and a suitable residual pressure wave reference in accordance with FIG. 4B is selected and the corresponding state detection data '2', '3' or '4' is selected and assigned to those print data.

Figure 6A:
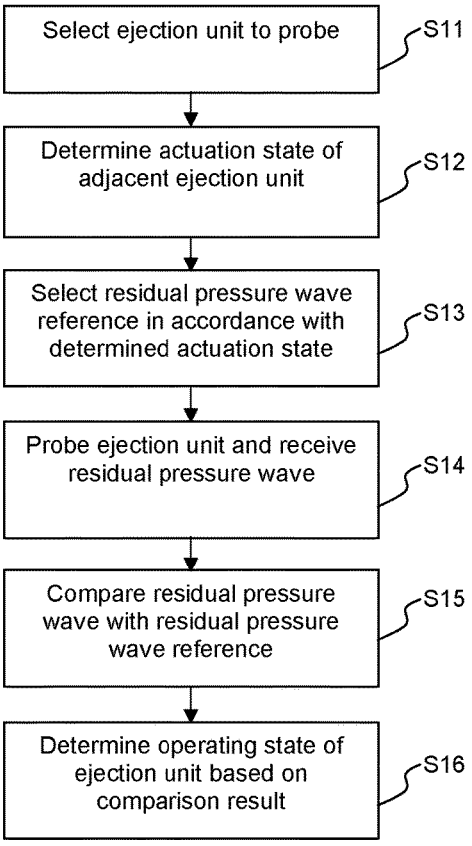
FIG. 6A is a schematic representation of a first embodiment of a method according to the present invention.

FIG. 6A shows an exemplary method according to the present invention and according to the embodiments of FIGS. 3A/3B and 4A/4B, although the method according to FIG. 6A is not limited to the embodiments of FIGS. 3A/3B and 4A/4B. In this exemplary method of FIG. 6A, the analysis of the detected residual pressure wave includes a comparison with one residual pressure wave reference. In particular, an ejection unit is selected to be probed (S11) and an actuation state of an adjacent ejection unit is determined (S12). This second step S12 of the method may be based on an analysis of the print data conform the embodiments of FIGS. 3A/3B and 4A/4B or may be based on any other suitable method.

Based on the outcome of the second step S12, a suitable residual pressure wave reference is selected (S13) and an actual residual pressure wave is collected (S14). Based on a comparison of the selected residual pressure wave reference (S15), an operating state of the ejection unit is determined (S16).

In the embodiment of FIG. 6A, it is presumed that the adjacent ejection units are in an operative state. So, if an adjacent ejection unit is to expel a droplet (i.e. its relevant print data corresponds to image data '1'), it is presumed that a corresponding pressure wave is actually correctly generated. If not, the cross-talk component in the residual pressure wave of the probed ejection unit will be different and, as a consequence, the detected residual pressure wave will not correspond to the residual pressure wave reference.

Thus, it will be determined that the probed ejection unit is not in a good operating state, while in fact the adjacent ejection unit is not operating correctly. So, the method according to FIG. 6A may be extended by additional state detections of the adjacent ejection units in order to arrive at a final determination of the operating state. In such an extended embodiment, it may be decided to treat such an ejection unit as being in a non-operating state, while assessing the operating state of its adjacent ejection units, for example.

Figure 6B:
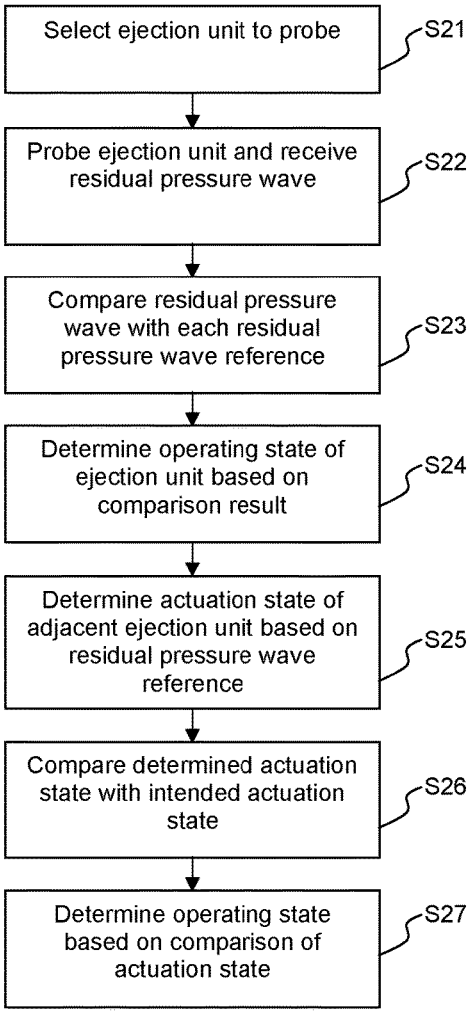
FIG. 6B is a schematic representation of a second embodiment of a method according to the present invention.

In another embodiment, which is illustrated in FIG. 6B, a detected residual pressure wave (S21 and S22) is not only compared to one pre-selected residual pressure wave reference, but is compared with each available residual pressure wave reference (step S23). Then, in a next step (S24), it may be determined that the ejection unit is in a good operating state, if the comparison shows that the detected residual pressure wave corresponds to one of the residual pressure wave references.

In an additional/optional further step (S25) the residual pressure wave reference is used to trace what the actuation state of the adjacent ejection units was at the time that the relevant ejection unit was probed, e.g. based on the table of FIG. 3B. If the residual pressure wave corresponds to residual pressure wave reference A, it is determined that both adjacent ejection units were in a non-actuated state. The actual actuation state of the adjacent ejection units may now be compared to an intended actuation state, which is derivable from the print data (e.g. FIG. 3A). If the print data indicate image data '1', it is concluded that it was intended that the adjacent ejection unit was actuated; if the print data indicate image data '0', it is concluded that it was not intended that the adjacent ejection unit was actuated. The intended actuation state and the determined actuation state are compared (S26). Based on the comparison, a conclusion regarding the operating state may be drawn (S27): if the intended actuation state and the determined actuation state are determined to be different, it may be concluded that such adjacent ejection unit was not in an operating state.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for detecting an operating state of an ejection unit of an inkjet print head, the inkjet print head comprising a first ejection unit and a second ejection unit, each ejection unit comprising a pressure chamber for holding an amount of liquid;

an actuator operatively coupled to the pressure chamber, configured for generating a pressure wave in the amount of liquid;

a sensor operatively coupled to the pressure chamber for sensing a residual pressure wave in the amount of liquid;

an orifice operatively coupled to the pressure chamber for ejecting a droplet of liquid upon generation of an ejecting pressure wave;

wherein the method comprises the steps of a) generating a pressure wave in the amount of liquid in the pressure chamber of the first ejection unit;

b) sensing a residual pressure wave in the amount of liquid in the pressure chamber of the first ejection unit;

c) providing a set of at least two residual pressure wave references, the at least two residual pressure wave references relating to at least two residual pressure wave sensing conditions for the first ejection unit respectively, each residual pressure wave sensing condition corresponding to an operating condition of the second ejection unit;

d) comparing the residual pressure wave as sensed in step b) with at least one residual pressure wave reference comprised in the set of at least two residual pressure wave references for determining the operating state of the first ejection unit.

2. The method according to claim 1, wherein the pressure chamber of the second ejection unit is adjacent to the pressure chamber of the first ejection unit.

3. The method according to claim 1, wherein each ejection unit comprises a piezo-electric element, the piezo-electric element having a piezo-electric layer, a first electrode arranged on a first side of the piezo-electric layer and a second electrode arranged on a second side opposite to the first side and being configured to function as the actuator when a voltage is applied over the first and second electrodes and to function as the sensor when no voltage is applied.

4. The method according to claim 1, the method comprising e) determining whether a pressure wave is present in the pressure chamber of the second ejection unit during performance of steps a) and b); and f) selecting a residual pressure wave reference from the set of at least two residual pressure wave references depending on the result of step e), wherein the step d) is performed after the step f), and the at least one residual pressure wave reference used in the step d) is the selected residual pressure wave reference from the step f).

5. The method according to claim 4, wherein the method is performed while an image is printed by image-wise ejection of droplets from the inkjet print head and wherein step e) comprises determining the presence of a pressure wave in the second ejection unit based on print data, the print data indicating when an ejection unit is to eject a droplet.

6. The method according to claim 5, wherein the print data include state detection data, the state detection data indicating when the operating state of an ejection unit is to be detected.

7. The method according to claim 6, wherein the state detection data of the first ejection unit indicates the residual pressure wave sensing condition of the first ejection device, which corresponds to the operating condition of the second ejection unit.

8. The method according to claim 6, wherein the state detection data of the first ejection unit includes a reference parameter, the reference parameter determining the residual pressure wave reference to be used, wherein the residual pressure wave reference has been selected in accordance with step f) while generating the print data.

9. The method according to claim 1, the method comprising h) comparing the residual pressure wave as sensed in step b) with each residual pressure wave reference from the set of residual pressure wave references;

i) determining the operating state of the first ejection unit based on the comparison performed in step h).

10. The method according to claim 9, wherein the method is performed while an image is printed by image-wise ejection of droplets from the inkjet print head based on print data, the print data indicating when an ejection unit is to eject a droplet and wherein the print data include state detection data, the state detection data indicating when the operating state of an ejection unit is to be detected.

* * * * *